US012116989B2

(12) United States Patent
Qin et al.

(10) Patent No.: US 12,116,989 B2
(45) Date of Patent: Oct. 15, 2024

(54) ELECTRIC AIR PUMP

(71) Applicant: JIANGSU YOUMAY ELECTRIC APPLIANCE CO., LTD., Jiangsu (CN)

(72) Inventors: Guangying Qin, Shanghai (CN); Xiaoling Tang, Shanghai (CN)

(73) Assignee: JIANGSU YOUMAY ELECTRIC APPLIANCE CO., LTD., Jiangsu (CN)

( * ) Notice: Subject to any disclaimer, the term of this patent is extended or adjusted under 35 U.S.C. 154(b) by 29 days.

(21) Appl. No.: 18/009,040

(22) PCT Filed: Sep. 23, 2020

(86) PCT No.: PCT/CN2020/117120
§ 371 (c)(1),
(2) Date: Dec. 8, 2022

(87) PCT Pub. No.: WO2022/041368
PCT Pub. Date: Mar. 3, 2022

(65) Prior Publication Data

US 2023/0272788 A1 Aug. 31, 2023

(30) Foreign Application Priority Data

Aug. 26, 2020 (CN) ..... 202010874734.8

(51) Int. Cl.
*F04B 35/04* (2006.01)
*F04B 49/06* (2006.01)
*F04B 53/00* (2006.01)

(52) U.S. Cl.
CPC ..... *F04B 35/04* (2013.01); *F04B 49/06* (2013.01); *F04B 53/001* (2013.01)

(58) Field of Classification Search
CPC ..... F04B 35/04; F04B 39/121; F04B 41/02; F04B 41/06; F04B 49/022; F04B 49/06;
(Continued)

(56) References Cited

U.S. PATENT DOCUMENTS 4,072,210 A * 2/1978 Chien ..... F04B 39/0016 184/5
9,879,682 B1 * 1/2018 Beliveau ..... A47C 27/082
(Continued)

FOREIGN PATENT DOCUMENTS

CN 205503419 U 8/2016
CN 205779791 U 12/2016
(Continued)

OTHER PUBLICATIONS

International Search Report for the International Application No. PCT/CN2020/117120 issued by the Chinese Patent Office on May 14, 2021.
(Continued)

*Primary Examiner* — Charles G Freay
*Assistant Examiner* — Benjamin Doyle
(74) *Attorney, Agent, or Firm* — IP & T GROUP LLP

(57) ABSTRACT

An electric air pump includes a housing, a cover body, an inflation module, and a control module. The housing is provided with a first vent port. The cover body covers the housing, and the cover body is provided with a second vent port. The inflation module is disposed in the housing. The control module is disposed in the housing, and the control module comprises a control circuit board and an air pressure detection unit. The air pressure detection unit is disposed on the control circuit board, and the control circuit board is electrically connected to the inflation module and configured for performing controlling.

6 Claims, 8 Drawing Sheets

(58) Field of Classification Search
CPC ..... F04B 49/08; F04B 53/001; F04D 25/084; F04D 25/166; F04D 29/503; F04D 29/663
USPC ..... 417/415
See application file for complete search history.

(56) References Cited

U.S. PATENT DOCUMENTS

| | | | | |
|---|---|---|---|---|
| 10,716,408 | B2 * | 7/2020 | Yang | F04D 25/068 |
| 10,888,173 | B2 * | 1/2021 | Shakal | F16F 15/08 |
| 11,703,059 | B2 * | 7/2023 | Huang | F04D 25/084 417/2 |
| 2002/0184711 | A1 * | 12/2002 | Mahoney | A47C 27/083 5/904 |
| 2003/0235507 | A1 * | 12/2003 | Kwang-Tsan | F04B 39/0055 417/312 |
| 2011/0284108 | A1 * | 11/2011 | Wang | F04B 39/0027 137/565.12 |
| 2015/0198168 | A1 * | 7/2015 | Tsai | F04D 27/008 415/60 |
| 2017/0280884 | A1 * | 10/2017 | Liu | A47C 27/082 |
| 2017/0342975 | A1 * | 11/2017 | Pan | F04B 53/001 |
| 2018/0335042 | A1 * | 11/2018 | Lin | F04D 27/001 |
| 2019/0211829 | A1 * | 7/2019 | Huang | F04D 25/166 |
| 2019/0271323 | A1 * | 9/2019 | Huang | A47C 27/083 |
| 2019/0301476 | A1 * | 10/2019 | Huang | F04D 25/166 |
| 2020/0046135 | A1 * | 2/2020 | Lau | F04D 25/0606 |
| 2020/0248706 | A1 * | 8/2020 | Liu | F04D 25/084 |
| 2020/0256345 | A1 * | 8/2020 | Huang | F04D 29/503 |
| 2020/0386237 | A1 * | 12/2020 | Huang | F04D 25/08 |
| 2021/0003126 | A1 * | 1/2021 | Huang | F04D 25/166 |
| 2021/0018013 | A1 * | 1/2021 | Li | F04D 17/10 |

FOREIGN PATENT DOCUMENTS

| | | | | |
|---|---|---|---|---|
| CN | 107035703 | A | 8/2017 | |
| CN | 206753843 | U | 12/2017 | |
| CN | 108317097 | A | 7/2018 | |
| CN | 108799056 | A | 11/2018 | |
| CN | 208669548 | U | 3/2019 | |
| CN | 209115349 | U | 7/2019 | |
| CN | 209687693 | U | 11/2019 | |
| CN | 209875430 | U | 12/2019 | |
| CN | 210371367 | U * | 4/2020 | F04D 29/66 |
| CN | 111677681 | A | 9/2020 | |
| CN | 111852921 | A | 10/2020 | |
| CN | 212454758 | U | 2/2021 | |

OTHER PUBLICATIONS

Written Opinion for the International Application No. PCT/CN2020/117120 issued by the Chinese Patent Office on May 14, 2021.

Office Action (Notice of Reasons for Refusal) for the Japanese Patent Application No. 2022-549332 issued by the Japanese Patent Office of which drafting date is Jul. 25, 2023.

Office Action (Notice of Reasons for Refusal) for the Japanese Patent Application No. 2022-549332 issued by the Japanese Patent Office of which drafting date is Dec. 21, 2023.

Office Action for the Chinese Patent Application No. 202010874734.8 issued by the Chinese Patent Office on May 22, 2024 and Search Result thereof.

European Search Report for the European Patent Application No. 20951036.1 issued by the European Patent Office on Aug. 25, 2023.

Office Action (Communication pursuant to Article 94(3) EPC) for the European Patent Application No. 20951036.1 issued by the European Patent Office on Sep. 20, 2023.

* cited by examiner

ELECTRIC AIR PUMP

CROSS-REFERENCE TO RELATED APPLICATION

The present disclosure is a national stage application of PCT/CN2020/117120 filed on Sep. 23, 2020, which claims the priority to the Chinese patent application with the filing No. CN202010874734.8 filed with the Chinese Patent Office on Aug. 26, 2020, and entitled "Electric Air Pump", the contents of which are incorporated herein by reference in entirety.

TECHNICAL FIELD

The present disclosure relates to the technical field of air pumps, and specifically to an electric air pump.

BACKGROUND ART

An inflatable product (such as an inflatable mattress or inflatable bed) can be used only after being inflated, and can be inflated by a hand-operated air pump, or inflated by an electric air pump, or installed with a built-in air pump for inflation.

However, in the prior art, when the air pump inflates the inflatable product such as the inflatable bed or the inflatable mattress, an internal air pressure cannot be accurately measured, causing that the air pressure is too large to make the air pump damaged or the air pressure is too small to make the inflatable product deform, so that the comfort degree is not enough.

SUMMARY

An objective of the present disclosure is to provide an electric air pump (gas pump), which can detect an internal air pressure (gas pressure) by an air pressure detection unit (gas pressure detection unit), and control an inflation module by a control module.

Embodiments of the present disclosure are realized as follows:

an electric air pump, including a housing, a cover body, an inflation module, and a control module, wherein the housing is provided with a first vent port; the cover body is provided to cover the housing, and the cover body is provided with a second vent port; the inflation module is provided inside the housing; and the control module is provided inside the housing, wherein the control module includes a control circuit board and an air pressure detection unit, the air pressure detection unit is provided on the control circuit board, and the control circuit board is electrically connected to the inflation module, and is configured for performing controlling.

In an embodiment, the inflation module includes a first unit and a second unit, the first unit is provided inside the housing, and configured to compress air, the first unit includes a main pump inflation motor; and the second unit is provided inside the housing, and configured to supplement air (gas), the second unit includes an auxiliary pump air supplement motor; in the above, the control circuit board is electrically connected to the auxiliary pump air supplement motor and the main pump inflation motor, and is configured for performing controlling.

In an embodiment, a partition plate is provided inside the housing, and the partition plate divides the housing into a first region and a second region, the first unit is provided in the first region, and the second unit is provided in the second region; in the above, the first vent port is provided at the first region, and the height of the partition plate is smaller than the depth of the housing, for making both the first region and the second region be in communication with the second vent port.

In an embodiment, the second unit further includes a silencer cotton and a silencer cotton compression plate, an outer surface of the housing is provided with a clamping groove, an inner bottom surface of the clamping groove is provided with a through-hole in communication with the second region, and the silencer cotton is provided in the clamping groove; and the silencer cotton compression plate is provided in the clamping groove, and configured to compress the silencer cotton tightly.

In an embodiment, the second unit further includes: an air-supplement-pump air inlet shell and an air-supplement-pump air outlet shell, the air-supplement-pump air outlet shell is connected to the air-supplement-pump air inlet shell, the air-supplement-pump air inlet shell has a supplemental air inlet hole; and the air-supplement-pump air outlet shell has a supplemental air outlet hole; in the above, the auxiliary pump air supplement motor is provided in the air-supplement-pump air inlet shell and the air-supplement-pump air outlet shell.

In an embodiment, the second unit further includes a plurality of fixation pins (fixation contact legs) and a damping plate (vibration reduction plate), the plurality of fixation pins are respectively fixed on the air-supplement-pump air inlet shell and the air-supplement-pump air outlet shell; the damping plate is provided in the second region, and the damping plate is fixed on the air-supplement-pump air inlet shell and the air-supplement-pump air outlet shell through the fixation pins.

In an embodiment, the control module further includes a power line, and the power line is provided on the cover body, and electrically connected to the control circuit board.

In an embodiment, the cover body is provided thereon with a wire box cover, and the wire box cover is connected to the housing, and configured to accommodate the power line.

In an embodiment, the control module further includes a press button board and an inflation control press button, the press button board is connected to the control circuit board; and the cover body is provided with a first hole, the inflation control press button is provided in the first hole, connected to the control circuit board through the press button board, and configured to control the main pump inflation motor.

In an embodiment, the electric air pump further includes a reversing module, the reversing module includes a reversing plate configured to switch an air duct and a micro-switch electrically connected to the control circuit board. The control module further includes a deflation control press button, the cover body is provided thereon with a second hole, and the deflation control press button is provided in the second hole, connected to the reversing module, and configured to control the reversing module and the main pump inflation motor.

In an embodiment, the control module further includes a USB interface, the cover body is provided with a third hole, and the USB interface is provided in the third hole, and electrically connected to the control circuit board.

In an embodiment, the control module further includes a light emitting element, the cover body is provided with a fourth hole, and the light emitting element is provided in the fourth hole, and electrically connected to the control circuit board.

Compared with the prior art, the present disclosure has the following beneficial effects.

In the present disclosure, the internal air pressure of the inflatable product such as the inflatable bed or the inflatable mattress can be detected by the air pressure detection unit, and the inflation module is controlled by the control module, so that the pressure intensity of the present electric air pump can be maintained.

In the present disclosure, the internal air pressure of the inflatable product such as the inflatable bed or the inflatable mattress can be detected by the air pressure detection unit, and then the main pump inflation motor and the auxiliary pump air supplement motor are controlled by the control module, so that air can be automatically supplemented by the second unit when the internal air pressure of the inflatable product is too low, and the pressure intensity of the present electric air pump is maintained, preventing a too low air pressure to make the inflatable product deform, it is also feasible that when the internal air pressure of the inflatable product reaches a preset value, the main pump inflation motor and the auxiliary pump air supplement motor are stopped by the control circuit board, preventing a too high air pressure from damaging the present electric air pump.

BRIEF DESCRIPTION OF DRAWINGS

In order to more clearly illustrate the technical solutions of embodiments of the present disclosure, drawings which need to be used in the embodiments will be introduced below briefly. It should be understood that the drawings below merely show some embodiments of the present disclosure, and therefore should not be considered as limitation to the scope, and a person ordinarily skilled in the art still could obtain other relevant drawings according to these drawings, without paying any creative effort.

Figure 1:
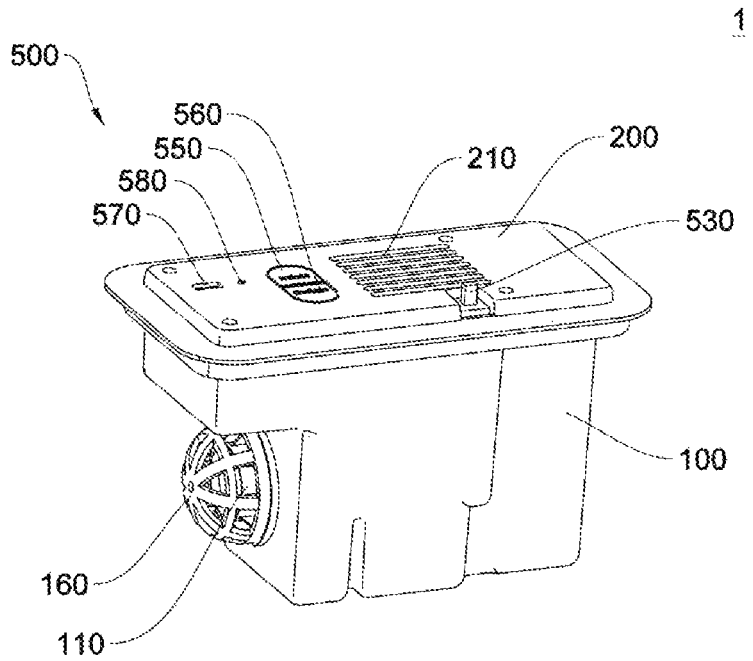
FIG. 1 is a structural schematic view of an electric air pump shown in an embodiment of the present disclosure.

Reference signs: 1—electric air pump; 100—housing; 110—first vent port; 111—partition plate; 120—clamping groove; 121—through-hole; 140—first region; 150—second region; 160—protective net; 170—valve assembly; 200—cover body; 210—second vent port; 220—first hole; 230—second hole; 240—third hole; 250—fourth hole; 300—first unit; 310—fan blade; 320—fan blade casing; 330—air sealing plate; 340—motor casing; 350—main pump inflation motor; 360—air outlet hole; 370—air inlet hole; 400—second unit; 410—air-supplement-pump air inlet shell; 411—supplemental air inlet hole; 420—air-supplement-pump air outlet shell; 421—supplemental air outlet hole; 430—auxiliary pump air supplement motor; 440—silencer cotton; 441—silencer cotton compression plate; 450—damping plate; 451—fixation pin; 500—control module; 510—control circuit board; 520—air pressure detection unit; 530—power line; 531—power supply board; 532—power-supply-board protective hood; 540—press button board; 550—inflation control press button; 560—deflation control press button; 570—USB interface; 580—light emitting element; 600—reversing module; 610—reversing plate; 620—micro-switch; 612—vent hole; 613—ramp rod; 630—support rod; 640—integrated mainboard; 650—reversing spring; 660—reversing cam; 670—inverse fastener; 680—electromagnetic valve; 800—inflation module; 900—wire box cover.

DETAILED DESCRIPTION OF EMBODIMENTS

Terms such as "first", "second", and "third" are merely for distinguishing the description, but do not indicate arrangement sequence numbers, nor can they be construed as indicating or implying importance in the relativity.

Moreover, the terms "horizontal", "vertical", "overhanging" and the like do not mean that the parts are required to be absolutely horizontal or overhanging, but may be slightly inclined. For example, by "horizontal" it merely means that a structure is more horizontal in comparison with "vertical", rather than being completely horizontal, while the structure can be slightly inclined.

In the description of the present disclosure, it should be noted that orientation or positional relationships indicated by terms such as "inner", "outer", "left", "right", "upper" and "lower" are based on orientation or positional relationships as shown in the drawings, or orientation or positional relationships of a product of the present disclosure when being conventionally placed in use, merely for facilitating describing the present disclosure and simplifying the description, rather than indicating or suggesting that related devices or elements have to be in the specific orientation or configured and operated in a specific orientation, therefore, they should not be construed as limitation to the present disclosure.

In the description of the present disclosure, unless otherwise specified and defined explicitly, terms "provide", "mount", "join" and "connect" should be construed in a broad sense, for example, it may be a fixed connection, a detachable connection, or an integral connection; it may be a mechanical connection, or an electrical connection; it may be a direct connection, an indirect connection through an intermediary, or inner communication between two elements.

Technical solutions of the present disclosure will be described below clearly and completely in combination with the drawings.

Referring to FIG. 1, it is a structural schematic view of an electric air pump 1 shown in an embodiment of the present disclosure. The electric air pump 1 includes a housing 100 and a cover body 200, the cover body 200 is provided to cover the housing 100 in a manner such as snap-fitting or bolt connection, a first vent port 110 is provided on a side wall of the housing 100, and a protective net 160 is connected to/on the first vent port 110; and the cover body 200 is provided with a second vent port 210. In the above, the first vent port 110 may be used as an air outlet or an air inlet of the electric air pump 1, and the second vent port 210 may be used as an air outlet or an air inlet of the electric air pump 1.

Figure 2:
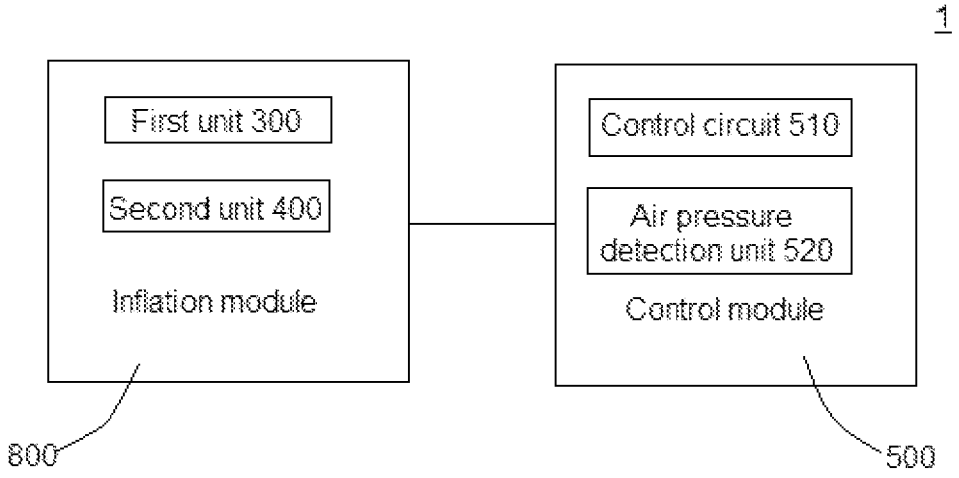
FIG. 2 is a structural schematic view of the electric air pump shown in an embodiment of the present disclosure.

Referring to FIG. 2, it is a structural schematic view of the electric air pump 1 shown in an embodiment of the present disclosure. An inflation module 800 and a control module 500 are provided inside the housing 100, and the inflation module 800 includes a first unit 300 and a second unit 400.

The control module 500 includes a control circuit board 510 and an air pressure detection unit 520, the air pressure detection unit 520 is provided on the control circuit board 510, and the air pressure detection unit 520 is an air pressure sensor, and can be connected to an inflatable product such as an inflatable bed or an inflatable mattress through a flexible air pipe, and configured to detect the internal air pressure of the inflatable product such as the inflatable bed or the inflatable mattress. In the above, an electrical component such as a processor or a controller may be provided on the control circuit board 510. The control circuit board 510 is electrically connected to the inflation module 800, and is configured for performing controlling.

In the present embodiment, the internal air pressure of the inflatable product such as the inflatable bed or the inflatable mattress can be detected by the air pressure detection unit 520, and the inflation module 800 is controlled by the control module 500, so that the pressure intensity of the present electric air pump 1 can be maintained.

Figure 3:
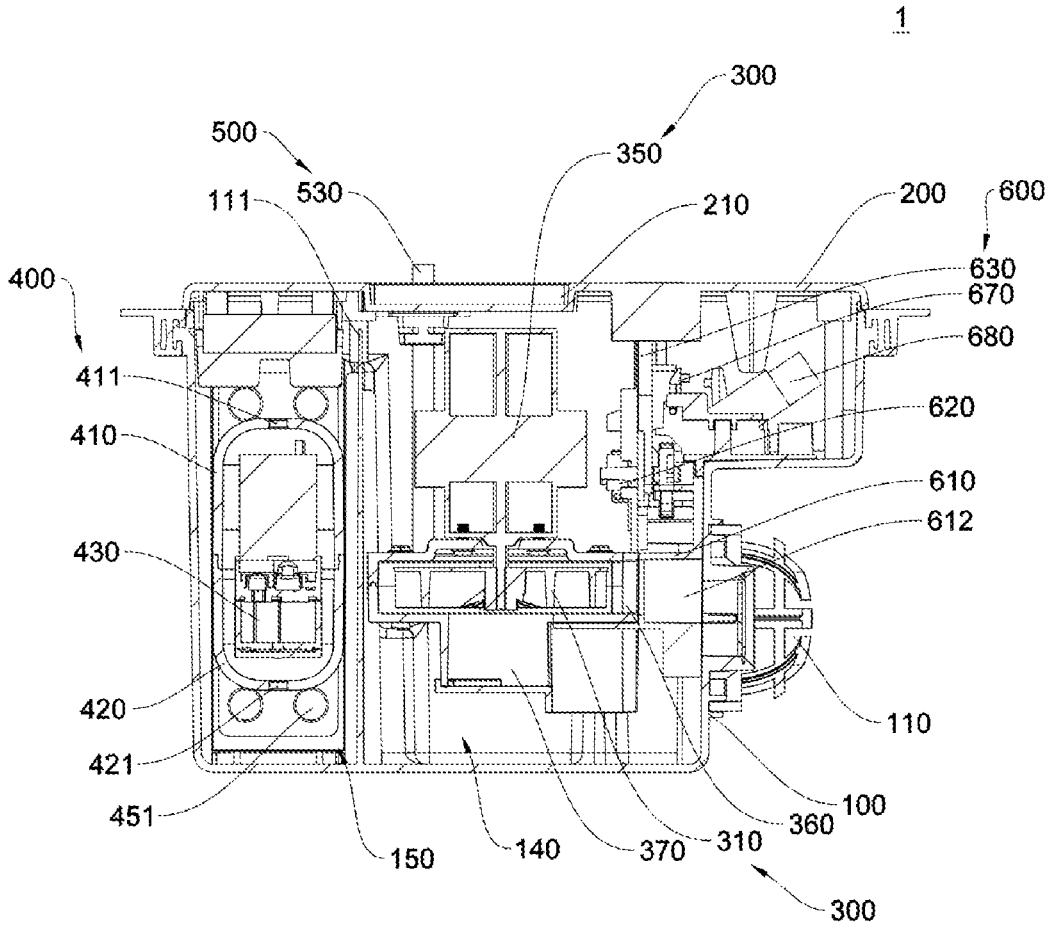
FIG. 3 is a sectional view of the electric air pump shown in an embodiment of the present disclosure.

Referring to FIG. 3, it is a sectional view of the electric air pump 1 shown in an embodiment of the present disclosure. The inflation module and the control module 500 are both provided inside the housing 100. A partition plate 111 is provided inside the housing 100, and the partition plate 111 divides the housing 100 into a first region 140 and a second region 150, wherein the first vent port 110 is provided at the first region 140, and the height of the partition plate 111 is smaller than the depth of the housing 100, for making both the first region 140 and the second region 150 be in communication with the second vent port 210. The first unit 300 is provided in the first region 140, and configured to compress air, and the second unit 400 is provided in the second region 150, and configured to supplement air.

The second unit 400 includes an air-supplement-pump air inlet shell 410, an auxiliary pump air supplement motor 430 and an air-supplement-pump air outlet shell 420, the air-supplement-pump air outlet shell 420 and the air-supplement-pump air inlet shell 410 are connected together by means of threads, snap-fitting, etc., the air-supplement-pump air inlet shell 410 has a supplemental air inlet hole 411, and the air-supplement-pump air outlet shell 420 has a supplemental air outlet hole 421; in the above, the auxiliary pump air supplement motor 430 is provided in the air-supplement-pump air inlet shell 410 and the air-supplement-pump air outlet shell 420.

The first unit 300 includes a main pump inflation motor 350 and a fan blade 310 in transmission connection with the main pump inflation motor 350. The main pump inflation motor 350 is fixed on a motor casing 340 through bolts, the fan blade 310 is provided in a fan blade casing 320, the top of the fan blade casing 320 is connected to the motor casing 340 through bolts, an air sealing plate 330 is fixed at the bottom of the fan blade casing 320 by means of bolts or snap-fitting, etc., and the fan blade casing 320 is provided with an air outlet hole 360 and an air inlet hole 370.

Figure 4:
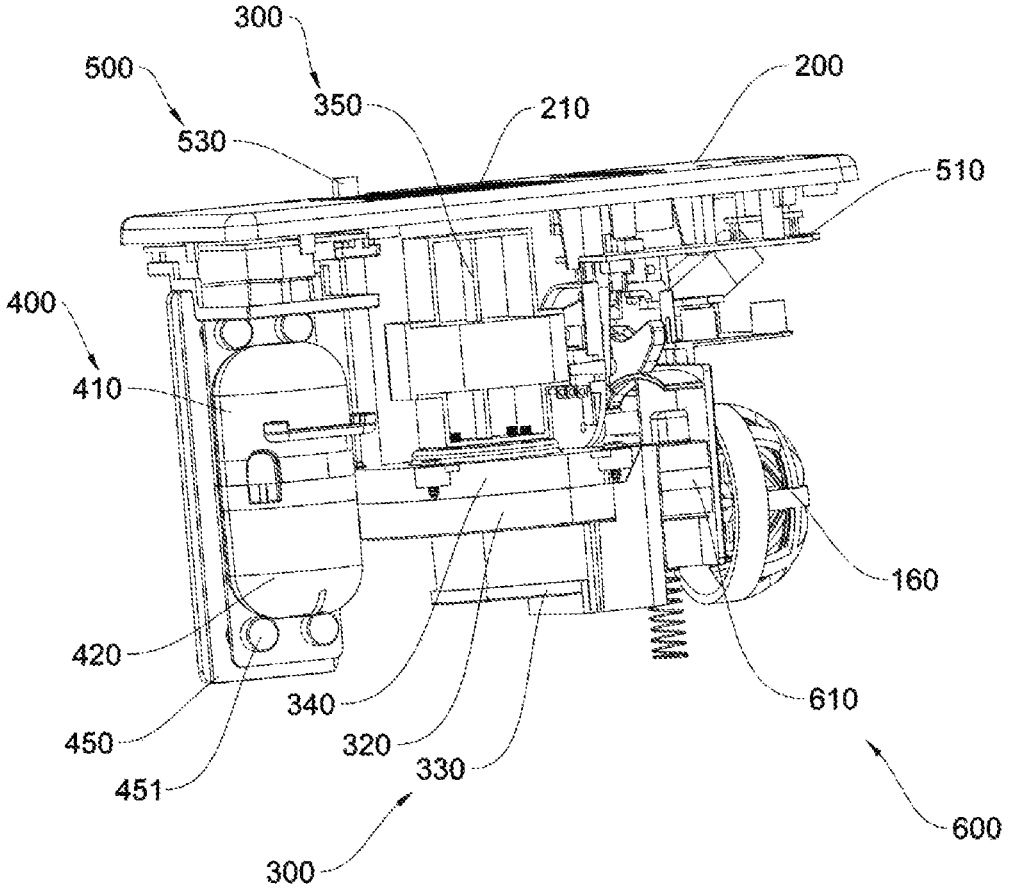
FIG. 4 is a partial structural schematic view of the electric air pump shown in an embodiment of the present disclosure.

Referring to FIG. 4, it is a partial structural schematic view of the electric air pump 1 shown in an embodiment of the present disclosure. The control module 500 is provided in the housing 100, and the control circuit board 510 is electrically connected to the auxiliary pump air supplement motor 430 and the main pump inflation motor 350, and is configured for performing controlling. The air pressure detection unit 520 is provided on the control circuit board 510, and can be connected to an inflatable product such as an inflatable bed or an inflatable mattress through a flexible air pipe and configured to detect the internal air pressure of the inflatable product such as the inflatable bed or the inflatable mattress. In the above, an electrical component such as a processor or a controller may be provided on the control circuit board 510.

In the present embodiment, the internal air pressure of the inflatable product such as the inflatable bed or the inflatable mattress can be detected by the air pressure detection unit 520, and then the main pump inflation motor 350 and the auxiliary pump air supplement motor 430 are controlled by the control module 500, so that air can be automatically supplemented by the second unit 400 when the internal air pressure of the inflatable product is too low, and the pressure intensity of the present electric air pump 1 is maintained, preventing a too low air pressure to make the inflatable product deform; it is also feasible that when the internal air pressure of the inflatable product reaches a preset value, the main pump inflation motor 350 and the auxiliary pump air supplement motor 430 are stopped by the control circuit board 510, preventing a too high air pressure from damaging the present electric air pump 1.

In an operation process, only when a user presses an inflation control press button 550 (refer to FIG. 5) in the control module 500, can the control circuit board 510 control the main pump inflation motor 350 to start to operate. The auxiliary pump air supplement motor 430 may be automatically turned on and off by the control circuit board 510.

The control module 500 further includes a power line 530, and the power line 530 is provided on the cover body 200, and is electrically connected to the control circuit board 510. The power line 530 may be externally connected to a power supply, and is configured to supply power.

The second unit 400 further includes a plurality of fixation pins 451 and a damping plate 450, and the plurality of fixation pins 451 are respectively fixed on the air-supplement-pump air inlet shell 410 and the air-supplement-pump air outlet shell 420; the damping plate 450 is provided in the second region 150, and the damping plate 450 is fixed on the air-supplement-pump air inlet shell 410 and the air-supplement-pump air outlet shell 420 through the fixation pins 451, and is configured to buffer vibration.

Figure 5:
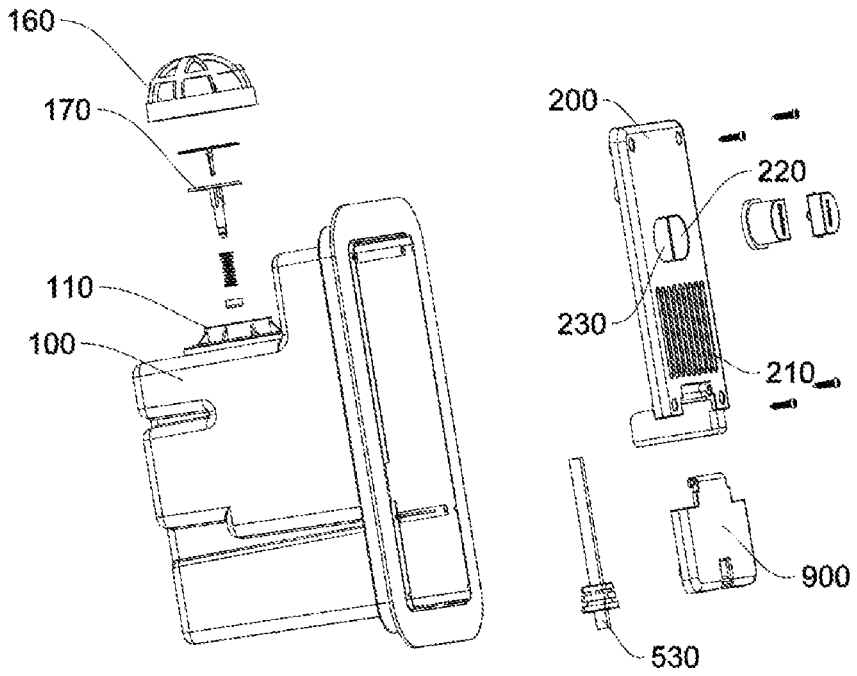
FIG. 5 is a partial structural schematic view of the electric air pump shown in an embodiment of the present disclosure.

Referring to FIG. 5, it is a partial structural schematic view of the electric air pump 1 shown in an embodiment of the present disclosure. The cover body 200 is provided thereon with a wire box cover 900, and the wire box cover 900 is connected to the housing 100, and is configured to accommodate the power line 530. In the present embodiment, the wire box cover 900 is hinged to one side of the cover body 200, and the wire box cover 900 may be connected to the housing 100 in a snap-fitting manner. The wire box cover 900 can be opened and closed, and the power line 530 can be placed in the wire box cover 900 for storage.

Figure 6:
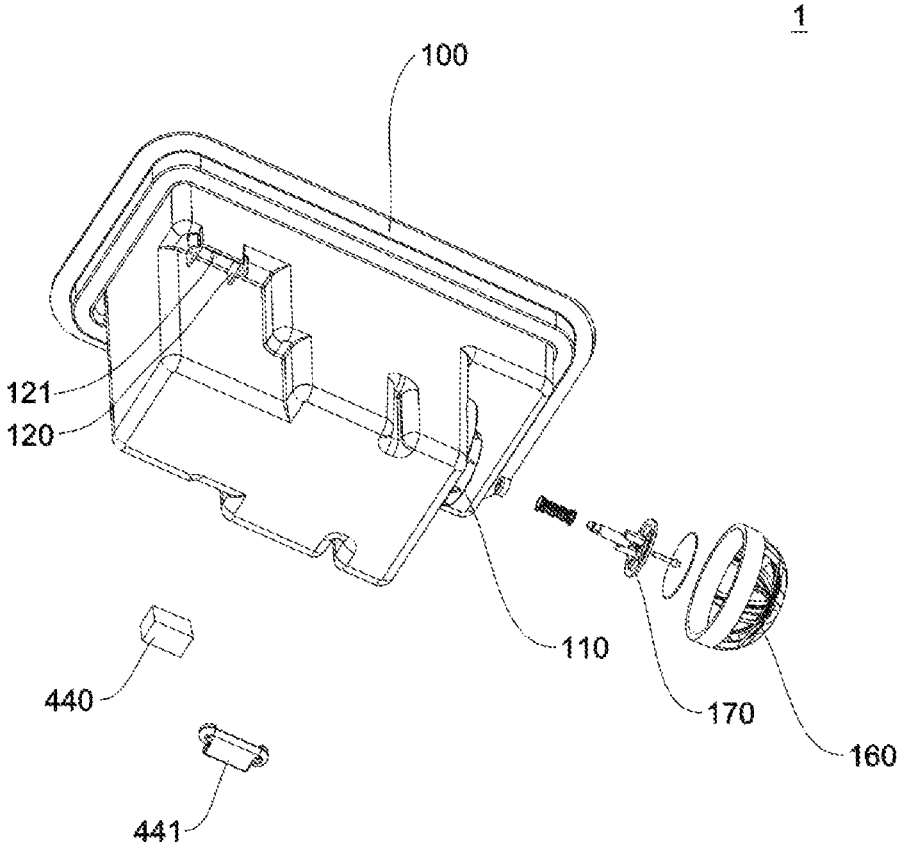
FIG. 6 is a partial structural schematic view of the electric air pump shown in an embodiment of the present disclosure.

Referring to FIG. 6, it is a partial structural schematic view of the electric air pump 1 shown in an embodiment of the present disclosure. The second unit 400 further includes a silencer cotton 440 and a silencer cotton compression plate 441, an outer surface of the housing 100 is provided with a clamping groove 120, an inner bottom surface of the clamping groove 120 is provided with a through-hole 121 in communication with the second region 150 (see FIG. 2), and the silencer cotton 440 is provided in the clamping groove 120; the silencer cotton compression plate 441 is provided in the clamping groove 120 in a manner such as snap-fitting or bolt connection, and tightly compresses the silencer cotton 440 in the clamping groove 120. The configuration of the silencer cotton 440 can reduce noises of the second unit 400 when the second unit 400 is turned on.

Figure 7:
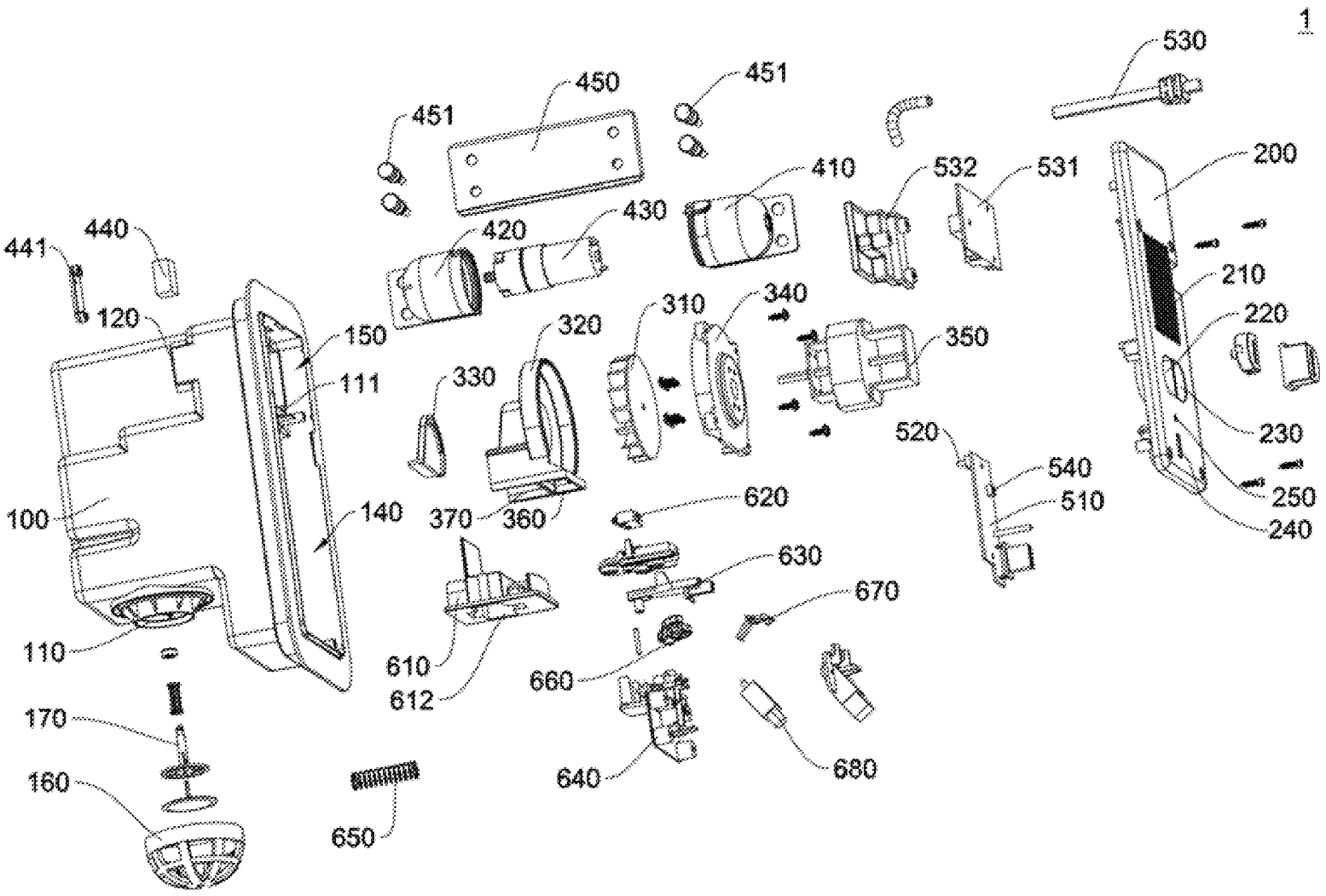
FIG. 7 is an exploded view of the electric air pump shown in an embodiment of the present disclosure.

Referring to FIG. 7, it is an exploded view of the electric air pump 1 shown in an embodiment of the present disclosure. The control module 500 further includes an inflation control press button 550 and a press button board 540, and the press button board 540 is connected to the control circuit board 510; the cover body 200 is provided with a first hole 220, the inflation control press button 550 is provided in the first hole 220, and the inflation control press button 550 is connected to the control circuit board 510 through the press button board 540, and is configured to control on or off of the main pump inflation motor 350. In an operation process, when the power line 530 is powered on, the inflation control press button 550 is pressed, the press button board 540 is triggered, and sends a signal, and the control circuit board 510 controls the main pump inflation motor 350 to start to operate.

The control module 500 further includes a power supply board 531 and a power-supply-board protective hood 532 provided outside the power supply board 531, the power supply board 531 is fixedly connected to the cover body 200, meanwhile the power supply board 531 is connected to the power line 530, and the power line 530 is fixed on the cover body 200 through the power supply board 531. In an operation process, the power supply board 531 is connected to the main pump inflation motor 350, and after the power line 530 is powered on, the power supply board 531 can send a signal, and the control circuit board 510 controls the main pump inflation motor 350 to start to operate.

The electric air pump 1 further includes a reversing module 600, the control module 500 further includes a deflation control press button 560, the cover body 200 is provided with a second hole 230, and the deflation control press button 560 is provided in the second hole 230, connected to the reversing module 600, and configured to control the reversing module 600 and the main pump inflation motor 350.

The reversing module 600 includes a reversing plate 610 configured to switch an air duct and a micro-switch 620 electrically connected to the control circuit board 510, and the micro-switch 620 can detect movement of the deflation control press button 560, and thus can control on or off of the main pump inflation motor 350.

When the reversing plate 610 moves to a first preset position, a vent hole 612 is butt-jointed to the air outlet hole 360 of the first unit 300, then the first vent port 110 is an air outlet of the present electric air pump 1, and the second vent port 210 is an air inlet of the present electric air pump 1, at this time, the air duct in the present electric air pump 1 is an air duct for inflation; and when the reversing plate 610 moves to a second preset position, the vent hole 612 is butt-jointed to the air inlet hole 370, then the air duct in the present electric air pump 1 is switched, the first vent port 110 becomes the air inlet of the present electric air pump 1, and the second vent port 210 becomes the air outlet of the present electric air pump 1, at this time, the air duct in the present electric air pump 1 is an air duct for deflation.

In an operation process, the air inlet hole 370 is located below the air outlet hole 360. When the deflation control press button 560 is pressed, the reversing plate 610 moves downwards to the second preset position, the air duct in the present electric air pump 1 is switched to be the air duct for deflation, the main pump inflation motor 350 is started under the action of the micro-switch 620, and the present electric air pump 1 deflates. When the deflation control press button 560 is reset, the reversing plate 610 moves to the first preset position, the air duct in the present electric air pump 1 is switched to be the air duct for inflation, and the main pump air inflation motor 350 waits for an instruction to inflate (inflation control press button 550).

Figure 8:
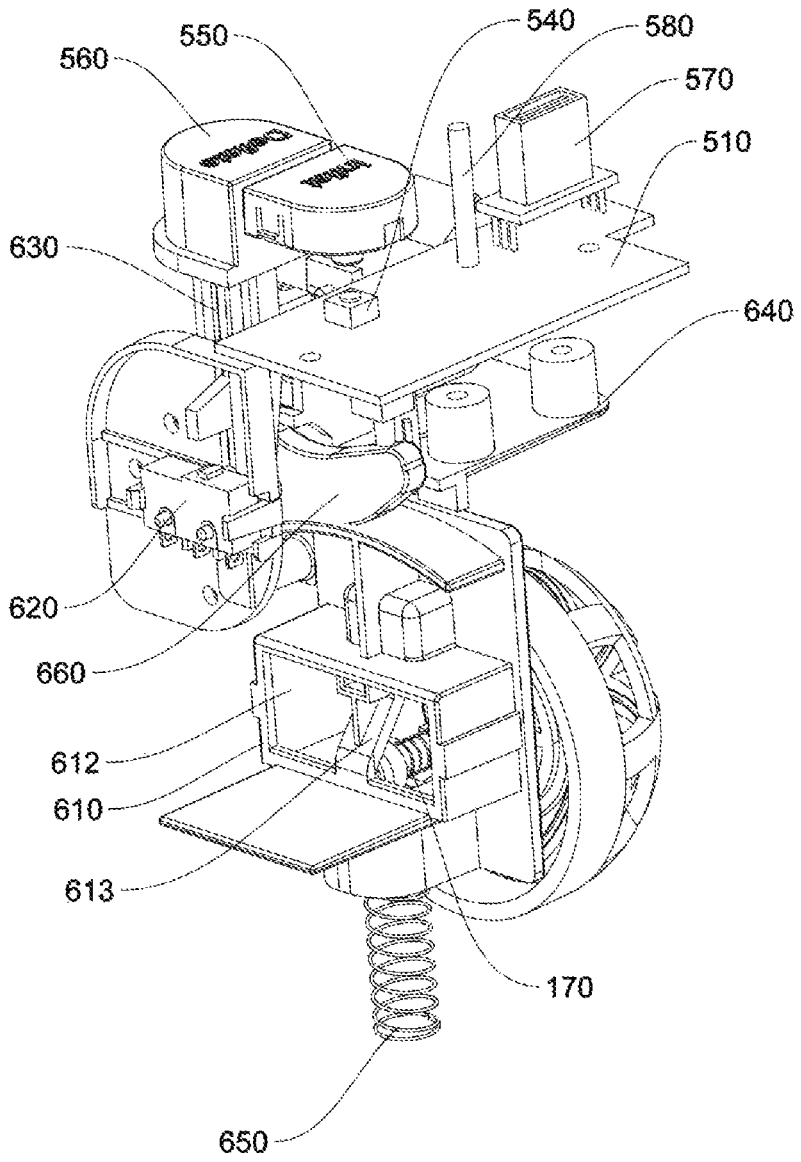
FIG. 8 is a partial structural schematic view of the electric air pump shown in an embodiment of the present disclosure.

Referring to FIG. 8, it is a top view of the electric air pump 1 shown in an embodiment of the present disclosure. The reversing module 600 further includes an integrated mainboard 640, a reversing cam 660, a support rod 630 and a reversing spring 650, and the integrated mainboard 640 is fixed on the housing 100; the reversing cam 660 has one end hinged to the integrated mainboard 640, a middle part connected to the support rod 630, and the other end being a movable end and abutting against the top of the reversing plate 610, and the support rod 630 has one end connected to the deflation control press button 560, and the other end connected to the reversing cam 660.

At the beginning, the reversing plate 610 is located at the first preset position, and when the deflation control press button 560 is pressed, the support rod 630 moves downwards for a certain distance, and the reversing cam 660 rotates by a certain angle, thus making the reversing plate 610 move downwards for a certain distance to reach the second preset position. Therefore, in the present embodiment, reciprocation of the reversing plate 610 is realized through the reversing cam 660 and the support rod 630.

The reversing spring 650 is provided between the reversing plate 610 and the housing 100, and is configured to buffer vibration.

Referring to both FIG. 7 and FIG. 3, the integrated mainboard 640 is provided thereon with an inverse fastener 670 and an electromagnetic valve 680 connected to the control circuit board 510, and the inverse fastener 670 may be snap-fitted with the support rod 630. In an operation process, after the deflation control press button 560 is pressed, the inverse fastener 670 is snap-fitted with the support rod 630, so that the deflation control press button 560 cannot be reset immediately, until the air pressure detection unit 520 detects that the internal air pressure of the inflatable product reaches a preset value, and then the electromagnetic valve 680 is allowed to push the inverse fastener 670, and make the inverse fastener 670 to be separated from the support rod 630.

A ramp rod 613 is provided at the vent hole 612 of the reversing plate 610, a valve assembly 170 is provided at the first vent port 110, the valve assembly 170 includes components such as a column core, a valve plate, a spring and a glass bead, and closing and opening of the first vent port 110 can be controlled by abutment of the column core of the valve assembly 170 against the ramp rod 613.

The valve plate of the valve assembly 170 of the first vent port 110 can be made of silica gel, and is in a normally closed state; when the first vent port 110 is the air inlet of the present electric air pump 1, the air duct in the present electric air pump 1 is an air duct for deflation at this time, the reversing plate 610 is located at the second preset position, and the valve assembly 170 can be opened under the action of an air flow, making the present electric air pump 1 operate normally; and when the first vent port 110 is an air outlet of the present electric air pump 1, the air duct in the present electric air pump 1 is an air duct for inflation at this time, and due to the function of the reversing module 600, the reversing plate 610 moves to the first preset position, and the column core of the valve assembly 170 moves relative to the ramp rod 613, so that the valve assembly 170 is opened, making the present electric air pump 1 operate normally.

Figure 9:
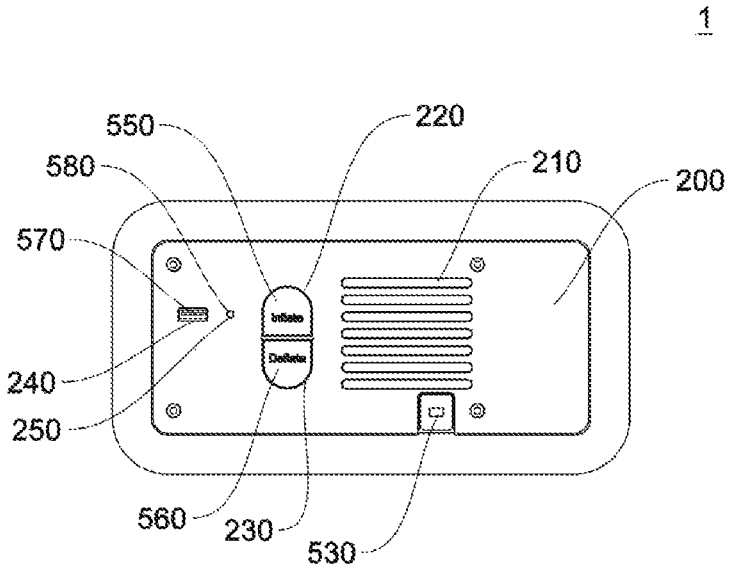
FIG. 9 is a top view of the electric air pump shown in an embodiment of the present disclosure.

Referring to FIG. 9, it is a top view of the electric air pump 1 shown in an embodiment of the present disclosure. The control module 500 further includes a USB interface 570, the cover body 200 is provided with a third hole 240, and the USB interface 570 is provided in the third hole 240, and electrically connected to the control circuit board 510. The configuration of the USB interface 570 can be used for charging a mobile phone, etc.

The control module 500 further includes a light emitting element 580, the cover body 200 is provided with a fourth hole 250, and the light emitting element 580 is provided in the fourth hole 250, and is electrically connected to the control circuit board 510. The light emitting element 580 may be an LED lamp, used as a night lamp.

The above-mentioned are merely preferred embodiments of the present disclosure, and not used to limit the present disclosure, and for those skilled in the art, various modifications and changes may be made to the present disclosure. Any modifications, equivalent substitutions, improvements and the like made within the spirit and principle of the present disclosure should be covered within the scope of protection of the present disclosure.

What is claimed is:

1. An electric air pump, comprising:

a housing, provided with a first vent port;

a cover body, provided to cover the housing, and provided with a second vent port;

an inflation module, provided inside the housing; and a control module, provided inside the housing, wherein the control module comprises a control circuit board and an air pressure detection unit, the air pressure detection unit is provided on the control circuit board, and the control circuit board is electrically connected to the inflation module, and is configured for performing controlling of the inflation module, wherein the inflation module comprises:

a first unit, provided inside the housing, and configured to compress air, wherein the first unit comprises a main pump inflation motor; and a second unit, provided inside the housing, and configured to provide supplemental compressed air, wherein the second unit comprises an auxiliary pump air supplement motor, wherein the control circuit board is electrically connected to the auxiliary pump air supplement motor and the main pump inflation motor, and is configured for performing controlling of the auxiliary pump air supplement motor and the main pump inflation motor;

a partition plate is provided inside the housing, and the partition plate divides the housing into a first region and a second region, the first unit is provided in the first region, and the second unit is provided in the second region; and wherein the first vent port is provided at the first region, and a height of the partition plate is smaller than a height of the housing, for making both the first region and the second region in communication with the second vent port, wherein the control module further comprises:

a power line, provided on the cover body, and electrically connected to the control circuit board, wherein the cover body is provided thereon with a wire box cover, and the wire box cover is connected to the housing, and configured to accommodate the power line, wherein the control module further comprises:

a press button board, connected to the control circuit board; and an inflation control press button, wherein the cover body is provided with a first hole, the inflation control press button is provided in the first hole, connected to the control circuit board through the press button board, and configured to control the main pump inflation motor, wherein the electric air pump further comprises:

a reversing module, comprising a reversing plate configured to switch an air duct and a micro-switch electrically connected to the control circuit board;

the control module further comprises:

a deflation control press button, wherein the cover body is provided with a second hole, and the deflation control press button is provided in the second hole, connected to the reversing module, and configured to control the reversing module and the main pump inflation motor, wherein the reversing module further comprises an integrated mainboard, a reversing cam, a support rod and a reversing spring, and the integrated mainboard is fixed on the housing;

the reversing cam has one end hinged to the integrated mainboard, a middle part connected to the support rod, and the other end being a movable end and abutting against a top of the reversing plate, and the support rod has a first end connected to the deflation control press button, and a second end connected to the reversing cam.

2. The electric air pump according to claim 1, wherein the second unit further comprises:

a silencer cotton, wherein an outer surface of the housing is provided with a clamping groove, an inner bottom surface of the clamping groove is provided with a through-hole in communication with the second region, and the silencer cotton is provided in the clamping groove; and a silencer cotton compression plate, provided in the clamping groove, and is configured to tightly compress the silencer cotton.

3. The electric air pump according to claim 1, wherein the second unit further comprises:

an air-supplement-pump air inlet shell, having a supplemental air inlet hole; and an air-supplement-pump air outlet shell, connected to the air-supplement-pump air inlet shell, and having a supplemental air outlet hole, wherein the auxiliary pump air supplement motor is provided in the air-supplement-pump air inlet shell and the air-supplement-pump air outlet shell.

4. The electric air pump according to claim 3, wherein the second unit comprises:

a plurality of fixation pins, respectively fixed on the air-supplement-pump air inlet shell and the air-supplement-pump air outlet shell;

a damping plate, provided in the second region, wherein the damping plate is fixed on the air-supplement-pump air inlet shell and the air-supplement-pump air outlet shell through the fixation pins.

5. The electric air pump according to claim 1, wherein the control module further comprises:

a USB interface, wherein the cover body is provided with a third hole, and the USB interface is provided in the third hole, and electrically connected to the control circuit board.

6. The electric air pump according to claim 1, wherein the control module further comprises:

a light emitting element, the cover body is provided with a fourth hole, and the light emitting element is provided in the fourth hole, and electrically connected to the control circuit board.

* * * * *